United States Patent [19]

Eriksson

[11] Patent Number: 4,688,473

[45] Date of Patent: Aug. 25, 1987

[54] WIND GUARD DEVICE

[76] Inventor: Lennart Eriksson, Floravägen 24, S-393 59 Kalmar, Sweden

[21] Appl. No.: 770,873

[22] PCT Filed: Dec. 10, 1984

[86] PCT No.: PCT/SE84/00420

§ 371 Date: Aug. 12, 1985

§ 102(e) Date: Aug. 12, 1985

[87] PCT Pub. No.: WO85/02668

PCT Pub. Date: Jun. 20, 1985

[30] Foreign Application Priority Data

Dec. 13, 1983 [SE] Sweden ..... 8306875

[51] Int. Cl.[4] ..... F23L 17/02

[52] U.S. Cl. ..... 98/79; 98/61; 237/55

[58] Field of Search ..... 98/79, 80, 119, 58, 98/66 R, 66 A, 32, 61; 237/55

[56] References Cited

U.S. PATENT DOCUMENTS 4,182,487 1/1980 Eriksson ..... 236/49

FOREIGN PATENT DOCUMENTS 7803220-8 11/1979 Sweden .

2569 of 1899 United Kingdom ..... 98/79

*Primary Examiner*—Henry A. Bennet

*Attorney, Agent, or Firm*—Fleit, Jacobson, Cohn & Price

[57] ABSTRACT

Wind guard device for the purpose of sustaining a gentle flow of gas in a gas passageway (6, 8, 11) between a building and the atmosphere surrounding the building and of reducing the wind effect of the atmosphere on the flow of gas, in conjuction with which a heat recovery arrangement (12) for the exchange of heat between the flow of gas and a heat absorbing medium is arranged in the gas passageway. The heat recovery arrangement is provided with a number of birstle-like projections (13) which form between them a number of gas passageways of irregular curved form. Said projections (13) may be heat-conducting and may be connected in a thermally conductive fashion to the heat recovery arrangement so as to increase the thermal absorption capacity of the latter. The heat recovery arrangement may be provided inside the gas passageway in the form of an outwardly inclined jacket, so that the gas which has been cooled by the heat exchange process can fall downwards into the aforementioned area of the gas passageway.

9 Claims, 4 Drawing Figures

WIND GUARD DEVICE

TECHNICAL FIELD

The present invention relates to a wing guard device for the purpose of sustaining a gentle flow of gas in a gas passageway between a building and the atmosphere surrounding the building. The expression gas passageway is used here to denote particularly, but not exclusively, a ventilation duct for ventilation air which flows through natural draught.

BACKGROUND ART

The ventilation in the majority of old houses occurs through so-called natural draught, also known as natural ventilation, chimney effect or ascending convection current, which means that outside air will find its way in via leaks and/or via various types of air inlet devices, for example so-called spring valves in the walls of the building, often near windows, by which the air is progressively heated and gradually rises through various ducts, for example special exhaust air ducts, usually brought together in a ventilation chimney which discharges above the roof of the house.

The aforementioned incoming air can with advantage be supplied by means of an air inlet device in accordance with Swedish patent specification No. 7803220-8, which ensures an even flow. An inlet devices of this kind can with advantage also be utilized in conjunction with the present invention, where an even flow is of importance.

One disadvantage of the previously disclosed arrangements has been their sensitivity to the effect of the wind, which manifests itself in the fact that the outside air is able, under certain wind conditions which are dependent, amongst other things, upon the wind velocity, the wind temperature and the wind direction, to produce a self-ejecting underpressure and/or to penetrate the ventilation outlets as an overpressure and interfere with the flow of the out-flowing ventilation air. The outside air is also capable, under certain wind conditions, of entering via the aforementioned air inlet devices and of counteracting a gentle inward flow in this way.

DISCLOSURE OF THE INVENTION

The objects of the invention is, therefore, to propose an arrangement of the kind described by way of introduction which will sustain both a gentle inward flow and a gentle outflow, and the sensitivity of which to the effect of the wind is considerably reduced. This object is achieved through the arrangement in accordance with the invention having been given the characteristic features indicated in claim 1.

Further developments of the invention may be appreciated from the sub claims.

The invention is based on observations to the effect that winds out in the open will avoid bushes. The wind will, as a general rule, find alternative routes rather than pass through bushes. If the bushes present an essentially cylindrical form to the direction of the air flow, the latter may change its plane in all directions, by so doing always meeting the same bushy, cylindrical outer form.

Movements of the air within the bushes are noticeably low. Because the wind is free to choose other routes, it will do precisely that. This is, of course, conditional upon the alternative routes being unobstructed and being in no way constricting (compressing, throttling or guiding), which is not normally the case around, for example, ventilation chimneys which project above the roof.

The external structure of the bushes is of critical importance for their function as described here. Generally speaking, therefore, the characteristics of the bushes will be achieved provided that their external structure can be maintained facing in a direction against the wind.

By providing in a gas passageway a wind guard consisting of a wind shielding with a large number of through apertures and with a large no. of elongated, narrow projections protruding into the apertures, a large number of gas passageways of irregular shape are formed thereby simulating the shape of natural bushes. The physical background to this is described below with reference to FIGS. 1 and 2.

DESCRIPTION OF THE FIGURES

The invention will be described in greater detail below with reference to the accompanying drawing, which shows a preferred embodiment of the invention.

PREFERRED EMBODIMENT

Figure 1:
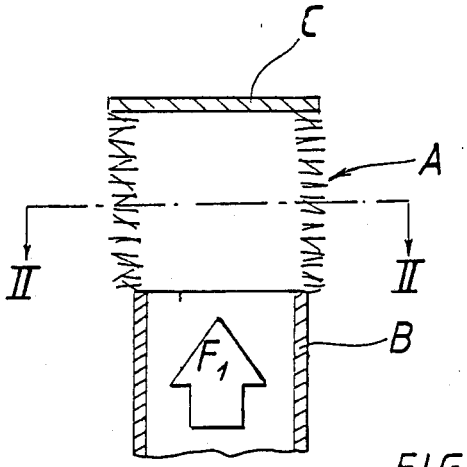
FIG. 1 shows in diagrammatic form an embodiment of the invention arranged in the discharge opening of a ventilation chimney.

FIG. 1 shows a wind shielding in the shape of a jacket A which is placed around a column-shaped opening in a ventilation chimney B, fitted with a lid C. The jacket A is made in this case of hairy pipes coiled in the form of a spiral into the shape of a cylinder. This jacket provides a surprisingly simple wind guard which effectively prevents the outflow from the chimney from being disturbed.

Figure 2:
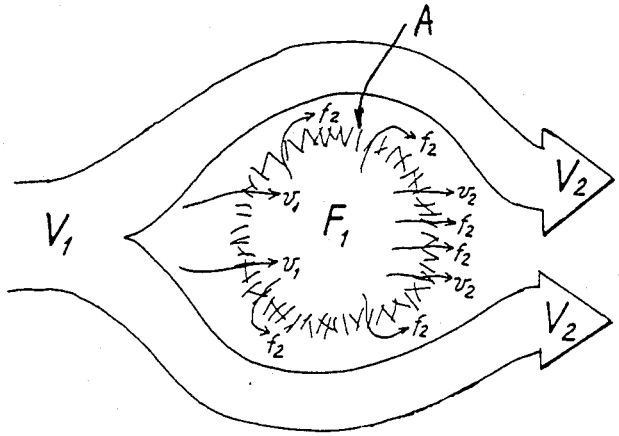
FIG. 2 shows a cross-section along the line II—II in FIG. 1.

In FIG. 2, which shows a section along the line II—II in FIG. 1, the reference designation V1 is used to denote the direction of the wind. Irrespective of the direction of the wind V1, most of the wind will avoid making contact with the jacket A, but will deviate in the manner shown by the arrows V2. The sum of the comparatively very small amounts of wind $v_1$ which nethertheless filter through the jacket A on the windward side are counterbalanced by the sum of the amounts of wind v2 on the lee side.

The flow of exhaust air $F_1$ is distributed in accordance with the drop in pressure evenly around the inside of the surface of the jacket A. The nature if its sub-division into subsidiary currents $f_2$ is remarkably even all the way around, although a certain degree of priority does, of course, attach to the direction of the wind accompanying the subsidiary currents in the direction $v_1-v_2$. The subsidiary currents $v_1$ unavoidably occupy a certain proportion of the available flow area, although this is compensated for by the fact that the total free area of the jacket A is made correspondingly greater than the area of $F_1$ so as to provide space for both the $v_1$ currents and $F_1$ = the sum of the $f_2$ currents. The small, but nevertheless identifiable overpressure unavoidably exerted by the $v_1$ currents on the windward side is compensated for on the whole by the underpressure which is produced on the other hand on the lee side of the jacket A through the ejector effect generated by the $V_2$ currents on both the $v_2$ and the $f_2$ currents.

The hairiness or the roughness and the degree of interjacent cavities shall be more or less equivalent to the roughness or the density exhibited in nature by the more dense types of bush. In a practical embodiment this may be simulated by means of tubes fitted with wires or bristles and coiled into the form of a cylinder, by a plastic mat—such as a doormat—formed into a cylinder, or by some other weather—and corrosion-resistant material of equivalent structure. The wires or bristles form projections which form between them a large number of gas passageways of irregular shape which provide the desired bush effect.

The tubes may, for example, consist of thermally conductive tubes, provided with bristles or projections of irregular shape, also serving as surface enlargement of the tubes. The tubes may, for example, consist of commercially available 'Spine-Fin' tubes where the projections consist of aluminum bristles.

If the 'Spine-Fin' tubes or similar hairy tubes or the like according to a further embodiment of the invention are used as a heat recovery arrangement for heat exchange between the gaseous fluid and a heat absorbing medium flowing through the tube, the bristles also serve to increase the heat-absorbing surface area of the tube. A cross-section through such a 'Spine-Fin' tube is shown in FIG. 4.

A common feature of these external enlargements—over and above the aforementioned heat-absorbing capability—is that their cavities/passageways present only low flow resistance at low rates of flow (Laminar natural draught flow). Any tendency towards disturbing high rates of flow—including those accuring locally and in the opposite direction—will result in the generation of strong turbulence, leading to high flow resistance, which will prevent such disturbances from finding their way through. The jacket A provides protection in this way against the gusts of wind which may penetrate under certain wind conditions.

The bushy jacket A may be arranged adjacent said air inlet device or in the discharge opening of the ventilation chimney in the surrounding atmosphere. Alternatively, the jacket A may be arranged at a distance into the the duct, as seen from the discharge opening, and then in the shape of a heat recovery device, which is described in greater detail in FIGS. 3–4 below. It is also conceivable to position a jacket in accordance with FIGS. 1–2 at the mouth opening in the form of a heat recovery device, which will be briefly described below. By executing the jacket A in the form of a heat recovery device, this will further reinforce the capability of the jacket to sustain a gentle through-flow of gas.

Figures 3, 4:
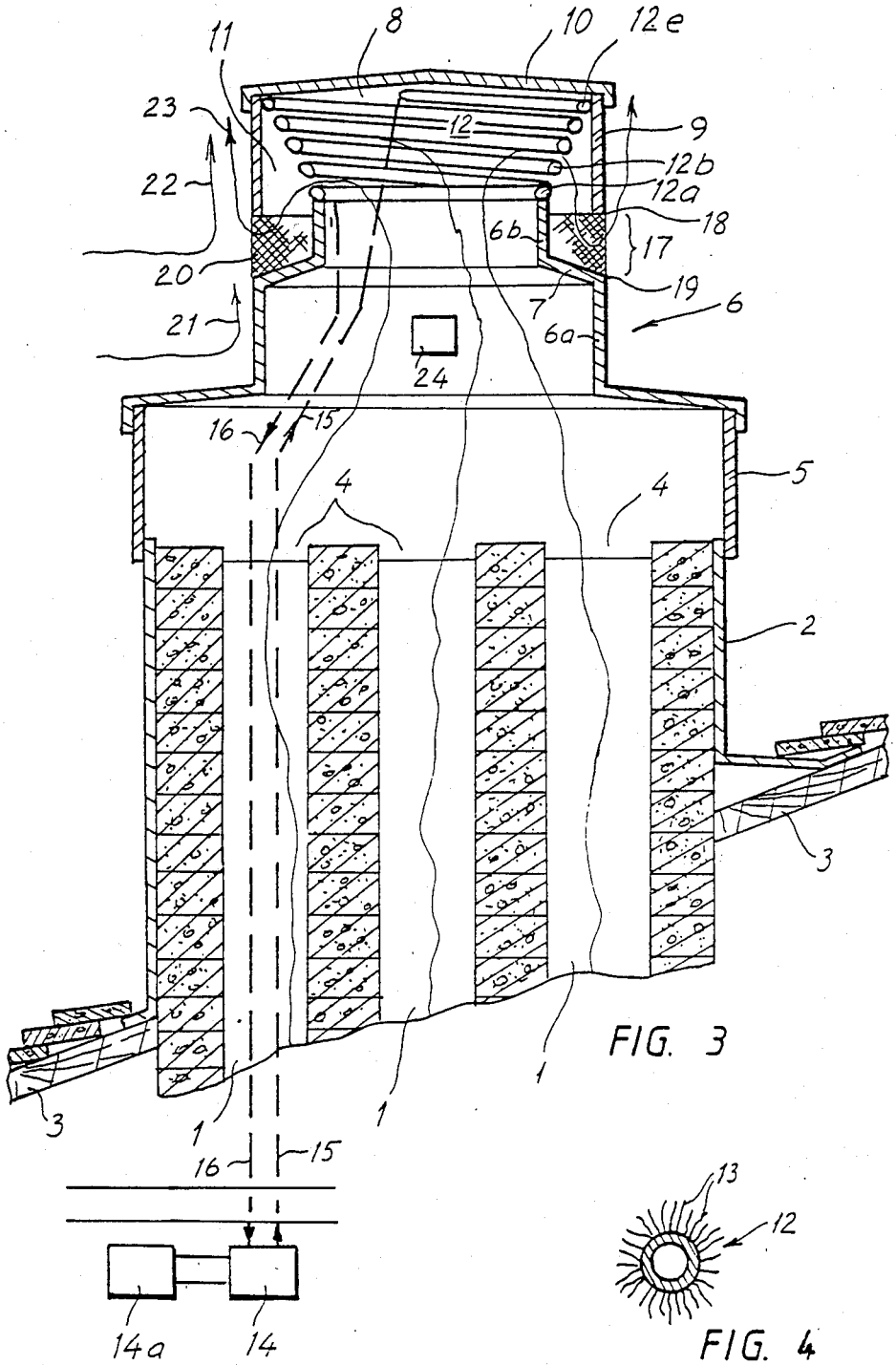
FIG. 3 shows a longitudinal section through a part of a ventilation installation into which a further development of the invention has been incorporated.
FIG. 4 shows a cross-section through a heat exchanger tube forming part of the arrangement in accordance with FIG. 3.

FIG. 3 shows a section of a ventilation installation for a residential building provided with a ventilation system which operates in accordance with the natural draught principle. A number (being three in the example shown) of vertical exhaust ducts 1 in a ventilation chimney 2, which passes through the roof 3 of a building (not shown here), are so arranged, with the help of lower inlet orifices (not shown here), as to take in used ventilation air from areas (not shown here) of the building, and to discharge via upper discharge orifices 4 the ventilation air, which is being caused to rise by the effect of the chimney, into a manifold box 5 on the ventilation chimney 2. The manifold box 5 becomes towards the top a cylindrical collecting duct 6 of reduced cross-sectional area in relation to the manifold box 5. The collecting duct 6 consists of a lower part **6*a* of the duct and an upper part 6*b* of the duct. The part 6*b* of the duct has a smaller diameter than the part 6*a* of the duct in order to provide the space for an outer duct 11, the function of which is described below. The transition between the parts 6*a* and 6*b* of the duct has the form of a truncated cone 7** with a high cone angle.

The collecting duct 6 discharges at the top into a roof space 8 in the form of a cylindrical duct shield 9 open at the bottom and suspended above the collecting duct 6, said duct shield being closed at the top by means of a roof element 10. The duct shield 9 has the same diameter as the lower part **6*a* of the duct, that is to say a greater diameter than the upper part 6*b* of the duct, and is lowered down over the upper part 6*b* of the duct in such a way that an outer duct 11 is formed by the duct shield 9 and by the outer wall of the upper part 6*b* of the duct and the conical transition part 7. The duct 11** in this way forms an area which is exposed to outside winds.

Both the manifold box 5, the collecting duct 6, the duct shield 9 and the roof element 10 are manufactured from plastic and/or sheet metal, preferably of a corrosion-resistant type.

A jacket 12 of the type denoted by A in FIGS. 1–2 is arranged as a heat recovery device in the form of a tubular heat exchanger in the roof space 8 for the purpose of recovering heat from the ventilation air rising from the collecting duct 6. The heat exchanger consists of a heat exchanger tube 12 coiled in the form of a spiral so as to produce a number of pipe coils **12*a*–12*e* of progressively increasing diameter in an upward direction, such that the envelope formed by the pipe coils forms a truncated, circular cone with a cone angle of about 5–20 degrees, and preferably of about 10–15 degrees. These cone angles have been selected having regard for the fact that a cold down-current can occur in the duct 6 at a cone angle of less than 5 degrees, and that the direction of flow can be diverted at a cone angle of more than 20 degrees, giving rise to unnecessary flow resistance. The different pipe coils 12*a*–12*e*** are arranged at a certain distance from each other corresponding approximately to their external enlargement elements (which are described below), so that the ventilation air can pass through.

The bottom pipe coil **12*a* is of essentially the same diameter as the upper part 6*b* of the duct, against the upper edge of which it is in contact. The top pipe coil 12*e* is of essentially the same diameter as the duct shield 9 and is in contact with the upper edge of the latter. By designing the tubular heat exchanger 12 in this way its inlet, that is to say the inner wall of the cone formed by the pipe coils 12*a–e*, will face the roof space 8, whereas its outlet, that is to say the outer wall of the aforementioned cone, the height of which is slightly lower than that of the duct shield 9, will offer protection for the aforementioned screen and will face the inner duct 11**.

The tubular heat exchanger consists in the embodiment shown here of a heat exchanger tube 12 of the aforementioned 'Spine-Fin' type with external enlargement projections 13, see FIG. 4, but may naturally be of some other, similar form.

The heat exchanger tube contains a heat-absorbing medium, a so-called brine, for example water to which glycol or alcohol has been added as an anti-freezing medium. The heat-absorbing medium is pumped by a heat pump 14, arranged for example in the cellar of the building, via a pipe 15 to the upper pipe coil 12*e* of the heat exchanger, then through all the remaining pipe coils, and then from the lowest pipe coil 12*a* via a pipe 16 back to the heat pump 14. This is so arranged in a previously disclosed fashion as to give off heat to a tap water accumulator 14*a* or similar.

The pipes 15 and 16, to which several heat exchangers may be connected, should preferably be routed via one of the exhaust air ducts 1 down to the cellar, but may, of course, be routed in other ways.

The cylindrical jacket surfaces of the part 6*a* of the duct and the duct shield 9, which are arranged coaxially one above the other, are positioned at a certain distance from each other so as to form an annular gap 17 which serves as the outlet from the duct 11 into the surrounding atmosphere. The gap 17 is thus defined at the top by the lower edge 18 of the duct shield 9, and at the bottom by the upper edge 19 of the part 6*a* of the duct.

Although the heat recovery jacket 12, which is situated inside the duct 11 and thus in an area which is exposed to the effect of the wind from the surrounding atmosphere, is itself an effective wind guard, the protection which it affords may be further reinforced if the gap 17 is divided into a number of small openings, which may be obtained, for instance, by placing a grille 20 in front of the gap 17, as shown in FIG. 3. The grille may be replaced, in accordance with an alternative embodiment (not shown here), by a jacket A as shown in FIGS. 1–2.

The arrangement of such a grille or jacket in the gap 17 gives rise to turbulence in the flowing medium, said instances of turbulence, in line with what has been described above, affording additional improved protection against the effect of the wind.

The function of the arrangements is otherwise as follows.

The rising, warm ventilation air inside the exhaust air ducts 1 is collected in the manifold box 5 and then continues on its way towards the heat exchanger 12. Even at this stage, the manifold box 5 and the collection duct 6 have an important function to fulfil. Previously disclosed and supported by calculations in a building research report by university lecturer P. O. Nylund entitled 'Make allowance for air leaks', and published in 1983, is the fact that, disturbances such as a cold down-current can easily occur in individual, freely-discharging ventilation ducts, with negative consequences from the comfort and energy points of view.

The use of the arrangement with a manifold box and a collecting duct has the effect of noticeably reducing the risk of cold outside air descending into any of the exhaust air ducts. Nor can there be any doubt that the bringing together of the flows of exhaust air into a single collecting duct will, at the same time, mean that any wind passing over an imaginary unobstructed mouth of such a duct can give rise to a greater ejector effect than wind passing over individual ducts. The bringing together of the flows into a single duct will, however, involve the aforementioned significant countering of a cold down-current, and will also enable the problems associated with the effect of the wind to be collected together at a single point, thereby facilitating the taking of effective preventative measures and the concentrated recovery of heat in accordance with the invention.

When the rising, warm ventilation air reaches the heat exchanger 12 and passes through its pipe coils 12*a*–12*e*, the exchange of heat will take place between the ventilation air and the heat-absorbing medium inside the pipe coils. The ventilation air is cooled in the process, and falls downwards once it has passed through the pipe coils. Since the outlet side of the heat exchanger is inclined outwards in the direction of the duct 11, the ventilation air which has been cooled by the heat exchanger will fall down through the duct 11. The cooled ventilation air is prevented in this way from causing a cold down-current in the collection duct 6 and the exhaust air ducts 1.

The cooled ventilation air is guided by the outer walls of the conical transition part 7 and out towards the gap 17. The falling movement of the cooled air in the duct 11 produces an addition to the operating pressure of the ventilation system, which counteracts the tendency of the outside air to penetrate into the gap 17, which also plays a part in reducing the flow resistance of the heat exchanger.

The height of the orifice of the gap 17 which is exposed to the wind has been able to be kept low by the application of the invention, but without in itself imposing any limitations on a gentle, laminar, outward flow. The elongated form of the orifice of the gap is less sensitive to any outside air flow which may be directed towards it, at the same time as the design and position of its limiting surfaces also produce a favourable effect in the following manner.

The majority of any blowing outside air will pass around the essentially circular and similarly dimensioned limiting surfaces of the orifice of the gap without influencing the flow of air through the orifice of the gap. The small amounts of the flow of outside air which are not led away in the above-mentioned manner, but are diverted as shown, for example, by the arrow 21, will largely pass by the orifice of the gap without penetrating it. The principal reason why the orifice of the gap thus has no significant disturbing effect on the outward flow through the orifice of the gap is that the jacket surfaces of the part 6*a* of the duct and of the duct shield 9 lie in one and the same plane, and that the flows of outside air which are aimed directly at the orifice of the gap, as shown by the arrow 22, as well as any outflowing air 23, are ejected jointly by the aforementioned diverted airflows 21 which pass over the orifice of the gap. At the same time the direct overpressure against the orifice of the gap which the flows of outside air 21 exert is balanced out against the corresponding degree of underpressure due to the ejector effect produced by the air flows 21 passing over the orifice of the gap.

The above reasoning is also applicable in other directions of diversion which may arise, for example exactly contrary to the arrows 21–23.

The heat exchanger 12 illustrated and specified here thus permits an even through-flow of the ventilation air to take place without a troublesome pressure drop and with effective protection against the effects of the wind. It also provides effective drainage of any condensation which may occur.

It is appropriate to provide all the duct-forming surfaces as far as the heat exchanger 12 with insulation (not shown here) so as to prevent heat from being lost before the ventilation air reaches the heat exchanger. The duct shield 9 and the roof element 10 should also be insulated so as to prevent the loss of heat by radiation from the heat exchanger at low outside temperatures.

The pressure drop over the entire heat exchanger 12 has been measured in the case of one practical embodiment at a value as low as approximately 1 Pa in relation to a combined flow from the exhaust air ducts 1 of about 200 $m^3/h$. The measured value is extremely low in relation to the high degree of efficiency achieved.

The low pressure drop of 1 Pa corresponds to the desired value necessary in the optimum case in order to achieve the minimum conceivable effect on the thermal driving force of the natural draught system.

The large, unobstructed area of the heat exchanger provided primarily by the 'Spine-Fin' tubes or similar, or alternatively by heat exchanger pipes, means that the risk of an increased pressure drop as a result of contamination is very small. The heat exchanger tubes are also easily accessible for cleaning after removal of the duct shield 9 and the roof element 10, or alternatively after raising the entire arrangement on hinges.

Although the ventilation system illustrated here operates by natural draught, a small fan 24 is illustrated schematically in FIG. 1. Its purpose is to provide compensation during the non-heating season, when no energy is being consumed inside the building, for the lower driving force in the natural draught system which occurs as the outside temperatures begin to increase. It is usual at that time for people to increase their ventilation requirement by opening the windows to provide the desired quantity of air. By the use of a very small fan, which will not increase the aforementioned pressure drop when stationary, the intended volume of air of 200 $m^3/h$ may easily be achieved.

In accordance with the invention it is also possible to route one or more ducts from the spaces below the roof, where the temperature may rise steeply on exposure to the rays of the sun, to the heat exchanger. The desired flow from the exhaust air ducts may be impaired, however, if the flow of warm air from such spaces is too great. The fan 24 may be run at low speed in order to counteract the last-mentioned tendency.

The arrangement in accordance with the invention may also be used to take advantage of the thermal energy contained in the flue gases. The fundamental difference in this case is that more corrosion-resistant materials should be specified in the design. Furthermore any condensation, which in this case will contain substances which are harmful to the environment, will require to be collected, neutralized and led away; this can be achieved, for example, by means of a guttering around the chimney and by means of a pipe leading to a drain.

When use is made of 'Spine-Fin' tubes or similar as an alternative to the protective grille 20, these may be utilized as an additional heat recovery stage, and may—when connected to a separate heat pump unit—function as a wind convector, additionally with the collection of a certain amount of solar energy.

I claim:

1. Wind guard device for the purpose of sustaining a gentle flow of gas in a gas passageway between a building and the atmosphere surrounding the building, and reducing the effect of the wind on the flow of gas, characterized in that the wind guard device is arranged in an area of the gas passageway which is exposed to the effect of the wind, and that it consists of a wind shielding having a number of through apertures for said flow of gas, said wind shielding having elongated and narrow bristle-like projections being irregularly orientated and protruding into said through apertures and provided in a sufficient number so as to permit gentle outward flow of gas while minimizing inward flow of wing by forming between themselves a large number of curved gas passageways of irregular shape which, because of their irregular orientation of curvature and large number, cause heavy turbulences to be generated and thus an increased gas flow resistance in those of said curved gas passageways being exposed to gusts of wind.

2. Device in accordance with claim 1, characterized in that the wind shielding consists of a jacket-like construction being built up by several tube portions, for instance heat exchanging tubes, which form between themselves interspaces constituting said through apertures.

3. Device in accordance with claim 1, characterized in that the aforementioned area of the gas passageway, when viewed in a pre-determined direction of flow of said gas, exhibits an upward-facing gas passageway section which then becomes a downward-facing gas passageway section, and in that the wind shielding is arranged at the point of transmission between the aforementioned gas passageway sections, the downward-facing gas passageway section having at its lower portion a mouth, the boundary surfaces of the mouth adjacent to the mouth being situated in the same plane as the mouth.

4. Device in accordance with claim 3, characterized in that the boundary surfaces are in the form of two essentially cylindrical generated surfaces coaxially situated one above the other and which between themselves form an annular groove which constitutes the aforementioned mouth.

5. Device in accordance with claim 3, characterized in that the aforementioned mouth consists of a number of holes produced by means of a grille positioned in front of the mouth.

6. Device in accordance with claim 3, characterized in that the aforementioned mouth consists of a number of holes produced by means of a baffle arranged in the mouth and having the form of at least one jacket with a number of long projections of the aforementioned type which together form a number of gas passageways of irregular curved shape.

7. Device in accordance with claim 1, characterized in that the wind shielding forms a gas-permeable wall in the aforementioned area of the gas passageway, said wall being inclined outwards at about 5–20 degrees from the vertical plane.

8. Wind guard device for the purpose of sustaining a gentle flow of gas in a gas passageway between a building interior and the atmosphere surrounding the building, and reducing the effect of the wind on the flow of gas, wherein the wind guard device is positioned at an outlet of the gas passageway which is exposed to the effect of the wind, said wind guard device comprising a wind shielding defining a number of small, irregularly shaped through apertures for permitting outward flow of gas while minimizing inward flow of wind, said wind shielding having elongated and narrow bristle-like projections being irregularly orientated relative to each other and protruding into said through apertures and provided in a sufficient number so as to permit gentle outward flow of gas while minimizing said inward flow of wind by forming between themselves a large number of irregularly curved gas passageways which, because of their irregular curvature and large number, offer flow resistance to cause heavy turbulence to be generated and thus an increased gas flow resistance in those of said irregularly curved gas passageways that are exposed to gusts of wind.

9. Device in accordance with claim 8, wherein the wind guard device is of annular configuration.

* * * * *